United States Patent [19]

Görgen

[11] Patent Number: 4,754,930

[45] Date of Patent: Jul. 5, 1988

[54] TUBULAR WARP BEAM WITH AXIAL END FLANGES AND REINFORCING MEMBERS

[75] Inventor: Kurt Görgen, Wuppertal, Fed. Rep. of Germany

[73] Assignee: FMN Schuster GmbH & Co., KG, Hürth, Fed. Rep. of Germany

[21] Appl. No.: 66,293

[22] Filed: Jun. 25, 1987

[30] Foreign Application Priority Data

Jul. 9, 1986 [DE] Fed. Rep. of Germany ..... 3622978

[51] Int. Cl.[4] ..... B65H 75/14

[52] U.S. Cl. ..... 242/118.61

[58] Field of Search ..... 242/117, 118.6, 118.61, 242/118.62, 118.4, 118.41, 118.7, 118.8, 77.3, 77.4, 71.8

[56] References Cited

U.S. PATENT DOCUMENTS

| | | | |
|---|---|---|---|
| 1,549,604 | 8/1925 | Neu | 242/118.61 |
| 2,880,944 | 4/1959 | Harris | 242/118.62 |
| 3,214,112 | 10/1965 | Sinquefield | 242/118.6 |

FOREIGN PATENT DOCUMENTS

| | | | |
|---|---|---|---|
| 850863 | 10/1960 | United Kingdom | 242/118.61 |
| 907548 | 10/1962 | United Kingdom | 242/118.61 |

*Primary Examiner*—John M. Jillions

*Attorney, Agent, or Firm*—Diller Ramik & Wight

[57] ABSTRACT

A warp beam particularly adapted for warping, section warping or winding of threads, yarns, textile material or synthetic melt-spun polymeric plastic material which is defined by a metallic tube having axially opposite ends in which is inserted and fixed thereto an annular reinforcing/compensating member at each tube end, a flange member having a collar at each end with the collar being inserted in the annular reinforcing/compensating member, and each annular reinforcing/compensating member having a machined surface effectively compensating for out-of-roundness of the tube which results from manufacturing tolerances thus assuring when the elements of the warp beam are welded to each other a strong, unstressed, uniform, concentric and balanced structure.

20 Claims, 1 Drawing Sheet

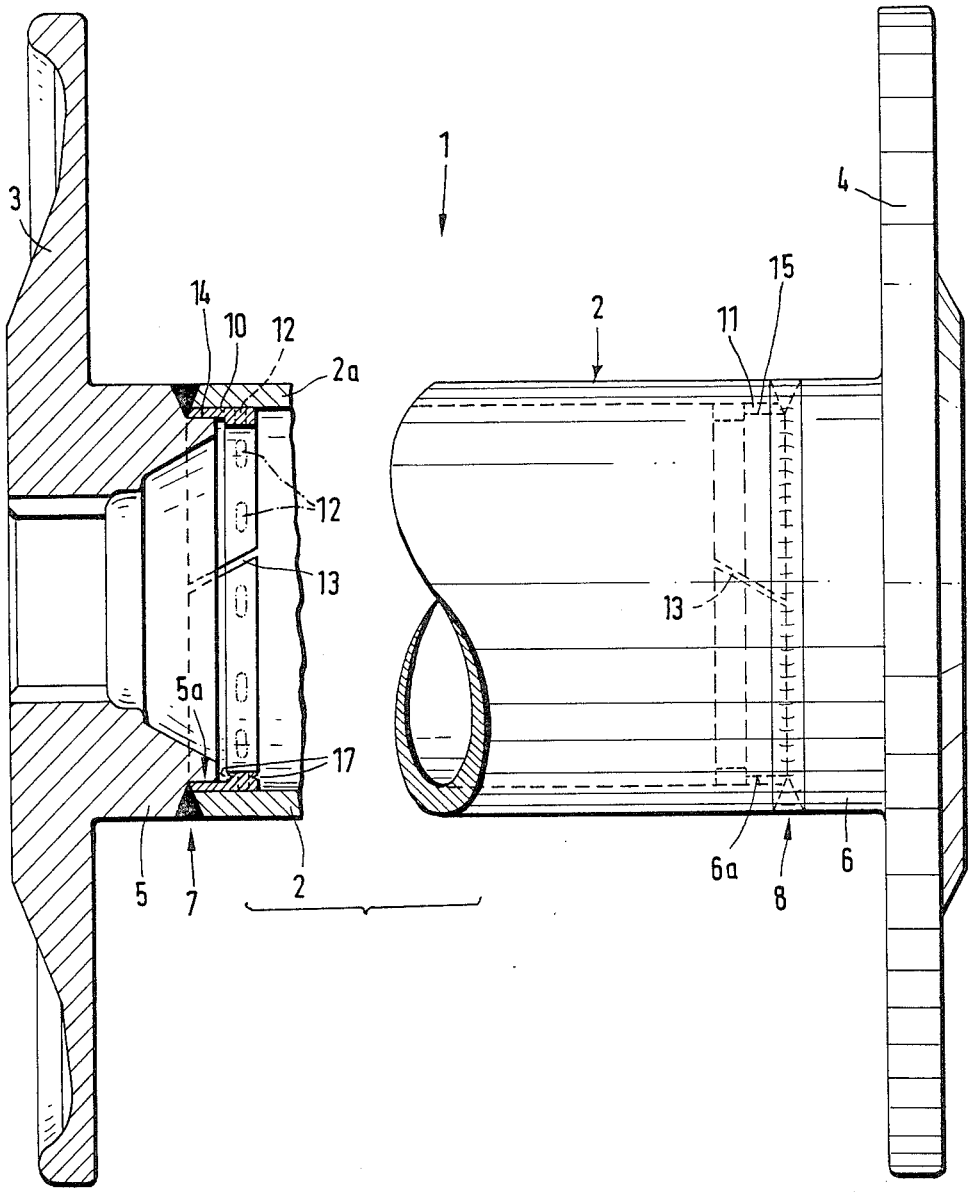
1
3
4
14
10
12
2a
2
11
15
12
13
13
5a
17
5
7
2
6a
8
6

TUBULAR WARP BEAM WITH AXIAL END FLANGES AND REINFORCING MEMBERS

BACKGROUND OF THE INVENTION

The present invention relates to the field of warp beams made of light tubular metallic material which are used for warping, section warping or winding threads of textile material (e.g., cotton) or polymeric/copolymeric thermoplastic melt-spun material (e.g., polyethylene, polypropylene).

As thread is wound upon warping beams to form thread packages the warp beams are subjected to traction forces and bending stresses during winding which cause undesired warp beam deflection. The latter occurs even if the warp beam is made to exacting tolerances. However, during the manufacture of warp beams exacting tolerances are not maintained simply because of the manner in which conventional warp beams are constructed. Normally the conventional warp beams are constructed from an aluminum tube which is generally produced by drawing, rolling or the like, and these processes alone create undesired tolerances primarily resulting from normal hardening of the metal as it is being formed. Moreover, though it is desired to form the tube to a perfectly circular shape, deviations therefrom occur, and most tubes are slightly oval and are also deformed along their axes (sword effect). These tolerance deviations are not negligible, and manufacturers have attempted to combat the same by using considerably oversized metal for forming the tubes of the warp beam. However, the greater the thickness of the tube, the more expensive the eventually formed warp beam and the greater the deviation from desired tolerances during formation.

For example, a purchaser/user of a warp beam requires a minimum tube wall thickness and this tube wall thickness must be maintained within desired tolerances. Obviously, each tube is desirably perfectly circular in cross-section and should also be perfectly axially straight, although in practice deviations obviously occur. However, if one begins with relatively thick tube wall thickness there is a possibility that the overall tolerances might be closer to desired tolerances but this is achieved only at the desired factor of increased cost because of the increased tube wall thickness.

The warp beam also has flanges at the ends of the tube and obviously the flanges must be so mounted that their axes are coaxial to effect symmetrical rotation of the warp tube. If the tube is not perfectly round or not perfectly straight, coaxial alignment between the flanges will not be effected by simply inserting centering collars of the flanges into the interior of the tube ends. For example, if the tube is slightly elliptical, the orientation of the ellipse at axially opposite ends of the tube is not necessarily the same and might be slightly peripherally/circumferentially offset. Thus, when collars of the flanges are inserted into these tube ends they self-center to the configuration of the internal elliptical surface of the tube, and if these internal elliptical surfaces are not perfectly longitudinally symmetrical, the axes of the flanges will not be coaxial. Because of the latter it has been the practice to machine or hollow-out the inner peripheral surface of each tube end to a diameter larger than the inside diameter of the raw-sized tube and generally correspondingly match the outside cylindrical surface of the collar of the flange fitted therein. Obviously this machining operation thinned the wall thickness at tube ends which creates a weakening point at the connection thereof with the associated flanges. Normally the connection is by way of a circumferential weld and since there is less wall material at the tube ends, the weld cannot be as strong as it might be if the wall thickness was not reduced. Hence, in those cases where the tube ends are machined to create a cylindrical internal surface as perfectly circular as possible, one must begin with a relatively thick raw-sized tube so that the wall thickness remaining after machining will not unduly weaken the eventually formed warp beam and will maintain desired predetermined manufacturing tolerances.

SUMMARY OF THE INVENTION

In keeping with the foregoing, the present invention provides warp beams which are manufactured to exacting tolerances utilizing metallic tubes of relatively smaller wall thickness than heretofore conventionally utilized and when welded to collars of flanges, the resulting warp beams are of maximum concentricity, straightness, uniformity and strength.

The invention is particularly characterized by providing the interior of the tube at each of its ends with an annular or ring-like reinforcing member of exacting tolerances and wall thickness such that upon the insertion of a flange collar in each annular reinforcing member, the flanges are self-centered and compensate for any unroundness resulting from manufacturing tolerances of the tube. The internal peripheral surface of each reinforcing member is machined to match the theoretical center axis of the less than perfectly circular tube and this automatically compensates for out-of-roundness of the tube and minor end-to-end axial symmetry (straightness).

The invention is further characterized by utilizing a tube of minimal wall thickness to meet purchaser/user minimum requirements which automatically reduces the cost of the warp beam because of the lesser metal involved. The thinner wall thickness is also easier to manufacture within desired tolerances, and since the internal circumferential surface of the tube ends is not hollowed, bored or machined, the original raw-wall thickness is utilized throughout the length of each tube thus increasing its overall strength and the strength at end weld points. Thus the annular or ring-like reinforcing member compensates for deviations in tolerances, yet accomplishes this without any weakening of the tube wall, particularly in the absence of any reduced thickness thereof. Since more material of the tube is available for welding at each end because the interior thereof is not machined, heat is eliminated more rapidly during the welding operation resulting in a higher Brinell hardness in the weld itself resulting in less internal strain and greater strength.

In further accordance with the invention, the reinforcing annular member or ring is inserted into the tube at opposite ends and is integrally connected thereto by spot welding, adhesive or heat shrinking. In the case of utilizing a weld to unitize the flange member, tube and reinforcing ring or member, a single weld can be utilized to secure all three members to each other which additionally effects a strong connecting joint.

If desired, particularly for purposes of assembly, the reinforcing member can be a split ring formed by a transverse slot or a gap, and the slot or gap is closed by welding when the reinforcing member is welded to the end of each tube.

Due to the latter and the maximization of the welding cross-section by connecting the flange member, reinforcing member and each tube end together by a single circumferential weld, increased strength and stability is assured.

In further accordance with the invention, each reinforcing member is provided with oppositely axially opening circumferential grooves or the like which can have balancing weights selectively connected thereto to eccentrically balance the warp beam to assure concentric rotation when in operation.

With the above, and other objects in view that will hereinafter appear, the nature of the invention will be more clearly understood by reference to the following detailed description, the appended claims and the several views illustrated in the accompanying drawing.

BRIEF DESCRIPTION OF THE DRAWING

The single FIGURE illustrates a fragmentary view of a warp beam constructed in accordance with this invention, partially in axial cross-section and partially in side elevation, and illustrates a collar of a flange member inserted in an annular reinforcing member which is in turn inserted into each end of a tube and welded thereto.

DESCRIPTION OF THE PREFERRED EMBODIMENT

A novel warp beam constructed in accordance with this invention which is particularly adapted for warping, section warping or winding of threads, yarns or textile material or synthetic melt-spun polymeric plastic material is generally designated by the reference numeral 1.

The warp beam 1 includes a metallic (aluminum) tube 2 having a predetermined wall thickness 2*a* between internal and external generally cylindrical surfaces (unnumbered). The wall thickness 2*a* is generally uniform throughout the length of the tube 2 and axially opposite ends (unnumbered) of the tube 2 are open.

A flange number 3, 4 is connected to each of the tube ends, and each flange or flange member includes a generally peripheral flange and an axial collar 5, 6 having respective reduced machined outer peripheral cylindrical surfaces 5*a*, 6*a*, respectively. Each collar outer peripheral surface 5*a*, 6*a* is in internal radially spaced relationship to the associated adjacent inner peripheral surfaces of the tube ends.

An annular reinforcing/compensating member or ring 10, 11 is inserted into the end of each tube 2 before the insertion therein of the peripheral surfaces 5*a*, 6*a*, thus resulting in the sandwiched relationship of each reinforcing/compensating member between the inner peripheral surface of each end of the tube 2 and the opposing outer peripheral surfaces 5*a*, 6*a* of the respective flange members 3, 4. Each annular reinforcing-/compensating member 10, 11 has an internal machined right-cylindrical surface 14, 15, respectively, which is as exactly machined to desired tolerances as is possible and matches the like accurately machined surfaces 5*a*, 6*a* of the flange member collars 5, 6, respectively. The accurately machined surfaces 14, 15 thereby compensate for any out-of-roundness of the tube 2 which might be slightly oval rather than perfectly circular in cross-section, by effectively creating an axis of rotation corresponding to the theoretical axis of the tube 2. In other words, if the inner peripheral surface of the tube 2 at the opposite ends thereof is of an oval shape and the cross-section of the oval shape is displaced circumferentially the center axis of rotation of each tube end would be different. Stated another way, the axis or axes of each oval shaped tube end would not be perfectly aligned or concentric end-to-end and thus there would be a natural built-in wobble when the warp beam 1 is rotated. However, due to the precise machining of the surfaces 5*a*, 6*a* and 14, 15, the axis of rotation of the warp beam 1 is effectively the axis of generation of the surfaces 14, 15 which in effect are essentially along the theoretical center axis of the tube 2 or as close thereto as possible. Thus, when the flange members 3, 4; the reinforcing-/compensating members 10, 11 and the ends of the tube 2 are welded together, as at 7, 8 and 12, a relatively rigid concentric and strong warp beam 1 is created. A great degree of measure of the strength of the warp beam 1 resides in the fact that the thickness 2*a* of the tube 2 is not reduced in any fashion and corresponds to the raw-wall thickness thereof. Furthermore, since the constant, unbored, unchanged raw wall thickness 2*a* of the tube 2 is retained, the circumferential welds 7, 8 are automatically deeper than usual and thus are stronger than usual, noting in particular that the welds 7, 8 not only weld each collar 5, 6 to its associated tube end, but also are radially deep enough to weld the annular reinforcing-/compensating members 10, 11. The latter forms an extremely rigid unified connection which is highly reinforced, reduces weld point loading, increases heat dissipation thus improving Brinell hardness, and further reduces deformation stresses. Thus one can use roughly sized tubes 2 of minor wall thickness 2*a* to make extremely accurate, yet inexpensive, warp beams well within desired tolerances of concentricity, roundness, straightness, etc.

The annular reinforcing/compensating rings 10, 11 can either be solid rings or each can be provided with a generally transverse slot or a gap 13. The slot 13 allows each of the annular reinforcing/compensating members 10, 11 to be flexed inwardly during insertion into the ends of the tube 2, but the inherent resiliency causes the reinforcing/compensating members 10, 11 to deflect outwardly sufficiently for the surfaces 14, 15 to return to their accurate right-cylindrical circumferential machined configuration. Once so inserted in each tube end, the spot welds 12 are used to secure the annular reinforcing/compensating members 10, 11 to the tube 2 and preferably the transverse slot or gap 13 is also filled with weld to rigidify each of the rings 10, 11.

In most cases the flanges or flange members 3, 4 are cast from aluminum alloy material which is different from the aluminum or aluminum alloy material of the tube 2. Since the surfaces 5*a*, 6*a* are machined, as are the surfaces 14, 15, any eccentricity or axial curvature of the tube 2 has not heretofore been resolved other than by efforts toward machining the interior peripheral surface of the tube 2 at its ends. However, the fact that the ends are out of desired tolerances and normally offset circumferentially relative to each other, creates difficulties at creating essentially axial alignment between the axes of the flanges 3, 4, yet this is virtually automatically assured by the annular reinforcing/compensating members 10, 11 in the fashion heretofore noted, absent a reduction in tube wall thickness and an increase in strength and an overall reduction in cost and at maximization of desired tolerances.

In further accordance with this invention, means generally designated by the reference numeral 17 are provided in each annular reinforcing/compensating member 10, 11 for securing balancing weights thereto to eccentrically balance the warp beam 1, much in the same manner as balancing an automobile tire/wheel, to assure optimum warp beam rotation absent wobble. The means 17 are two axially oppositely opening circumferential grooves to which weights can be clipped by intergral flanges thereof, thus avoiding the use of bores in the flanges 3, 4 as has been provided heretofore to mount balancing weights thereon.

Although in a preferred embodiment of the invention as has been specifically illustrated and described herein, it is to be understood that minor variations may be made in the apparatus without departing from the spirit and scope of the invention as defined in the appended claims.

I claim:

1. A warp beam particularly adapted for warping, section warping or winding of threads, yarns or like textile material or synthetic melt-spun polymeric plastic material comprising a metallic tube having opposite axial ends and inner and outer peripheral surfaces of predetermined inner and outer diameters, a flange member at each of said tube ends, each flange member including a generally peripheral flange and an axial collar, each said associated peripheral flange and axial collar being an integral one-piece generally homogeneous structure, each axial collar having an outer peripheral surface, each collar outer peripheral surface being defined by a first outer peripheral surface portion of a first predetermined diameter and a second outer peripheral surface portion of a second predetermined diameter less than-said first predetermined diameter, each collar second outer peripheral surface portion being in internal spaced relationship to an associated one of said tube end inner peripheral surfaces, each collar first outer peripheral surface first predetermined diameter being generally equal to said axial ends predetermined outer diameters, an annular reinforcing member having inner and outer peripheral surfaces, each annular reinforcing member being located between an associated collar second outer peripheral surface portion and an adjacent tube end inner peripheral surface, said annular reinforcing members surfaces effectively compensating for out-of-roundness of said tube resulting from manufacturing tolerances, and weld means for securing said tube, flange members and reinforcing members together as a unified structure.

2. The warp beam as defined in claim 1 wherein said securing means include at least one weld.

3. The warp beam as defined in claim 1 wherein said securing means include at least one weld between each tube end and its associated flange member.

4. The warp beam as defined in claim 1 wherein said securing means include at least one weld between each tube end and its associated reinforcing member.

5. The warp beam as defined in claim 1 wherein said securing means include at least one weld between each flange member and its associated reinforcing member.

6. The warp beam as defined in claim 1 wherein said securing means include at least one weld at each tube end between at least two of said tube ends, reinforcing members and flange members.

7. The warp beam as defined in claim 1 wherein said securing means include a single weld at each tube end between the adjacent tube end, flange member and reinforcing member.

8. The warp beam as defined in claim 1 wherein said securing means include a single weld at each tube end between the adjacent tube end, flange member and reinforcing member, and a second weld between each reinforcing member and its associated tube end.

9. The warp beam as defined in claim 1 wherein said securing means include a single weld at each tube end between the adjacent tube end, flange member and reinforcing member, and a second spot weld between each reinforcing member and its associated tube end.

10. The warp beam as defined in claim 1 wherein said securing means include at least one weld, and said one weld is a plurality of spot welds between each tube end and its associated reinforcing member.

11. The warp beam as defined in claim 1 wherein said securing means includes a heat-shrink connection between each reinforcing member and its associated tube end.

12. The warp beam as defined in claim 1 wherein said securing means includes an adhesive connection between each reinforcing member and its associated tube end.

13. The warp beam as defined in claim 7 wherein each of said reinforcing members include means for securing a weight thereto for eccentrically balancing said warp beam.

14. The warp beam as defined in claim 8 wherein each of said reinforcing members include means for securing a weight thereto for eccentrically balancing said warp beam.

15. A warp beam particularly adapted for warping, section warping or winding of threads, yarns or like textile material or synthetic melt-spun polymeric plastic material comprising a metallic tube having opposite axial ends and inner and outer peripheral surfaces, a flange member at each of said tube ends, each flange member including a generally peripheral flange and an axial collar, each axial collar having an outer peripheral surface, each collar outer peripheral surface being in internal spaced relationship to an associated one of said tube end inner peripheral surfaces, an annular reinforcing member having inner and outer peripheral surfaces, each annular reinforcing member being located between an associated collar outer peripheral surface and an adjacent tube end inner peripheral surface, said annular reinforcing members surfaces effectively compensating for out-of-roundness of said tube resulting from manufacturing tolerances, means for securing said tube, flange members and reinforcing members together as a unified structure, each reinforcing member is a split ring formed by a transverse gap, and a weld closes each gap.

16. A warp beam particularly adapted for warping, section warping or winding of threads, yarns or like textile material or synthetic melt-spun polymeric plastic material comprising a metallic tube having opposite axial ends and inner and outer peripheral surfaces, a flange member at each of said tube ends, each flange member including a generally peripheral flange and an axial collar, each axial collar having an outer peripheral surface, each collar outer peripheral surface being in internal spaced relationship to an associated one of said tube end inner peripheral surfaces, an annular reinforcing member having inner and outer peripheral surfaces, each annular reinforcing member being located between an associated collar outer peripheral surface and an adjacent tube end inner peripheral surface, said annular reinforcing members surfaces effectively compensating for out-of-roundness of said tube resulting from manufacturing tolerances, means for securing said tube, flange members and reinforcing members together as a unified structure, each reinforcing member is a split ring formed by a transverse gap, and said securing means includes a weld in each transverse gap securing each reinforcing member to the adjacent tube end.

17. A warp beam particularly adapted for warping, section warping or winding of threads, yarns or like textile material or synthetic melt-spun polymeric plastic material comprising a metallic tube having opposite axial ends and inner and outer peripheral surfaces, a flange member at each of said tube ends, each flange member including a generally peripheral flange and an axial collar, each axial collar having an outer peripheral surface, each collar outer peripheral surface being in internal spaced relationship to an associated one of said tube end inner peripheral surfaces, an annular reinforcing member having inner and outer peripheral surfaces, each annular reinforcing member being located between an associated collar outer peripheral surface and an adjacent tube end inner peripheral surface, said annular reinforcing members surfaces effectively compensating for out-of-roundness of said tube resulting from manufacturing tolerances, means for securing said tube, flange members and reinforcing members together as a unified structure, and each of said reinforcing members include means for securing a weight thereto for eccentrically balancing said warp beam.

18. A warp beam particularly adapted for warping, section warping or winding of threads, yarns or like textile material or synthetic melt-spun polymeric plastic material comprising a metallic tube having opposite axial ends and inner and outer peripheral surfaces, a flange member at each of said tube ends, each flange member including a generally peripheral flange and an axial collar, each axial collar having an outer peripheral surface, each collar outer peripheral surface being in internal spaced relationship to an associated one of said tube end inner peripheral surfaces, an annular reinforcing member having inner and outer peripheral surfaces, each annular reinforcing member being located between an associated collar outer peripheral surface and an adjacent tube end inner peripheral surface, said annular reinforcing members surfaces effectively compensating for out-of-roundness of said tube resulting from manufacturing tolerances, means for securing said tube, flange members and reinforcing members together as a unified structure, each of said reinforcing members include means for securing a weight thereto for eccentrically balancing said warp beam, and said weight securing means is a peripheral groove.

19. A warp beam particularly adapted for warping, section warping or winding of threads, yarns or like textile material or synthetic melt-spun polymeric plastic material comprising a metallic tube having opposite axial ends and inner and outer peripheral surfaces, a flange member at each of said tube ends, each flange member including a generally peripheral flange and an axial collar, each axial collar having an outer peripheral surface, each collar outer peripheral surface being in internal spaced relationship to an associated one of said tube end inner peripheral surfaces, an annular reinforcing member having inner and outer peripheral surfaces, each annular reinforcing member being located between an associated collar outer peripheral surface and an adjacent tube end inner peripheral surface, said annular reinforcing members surfaces effectively compensating for out-of-roundness of said tube resulting from manufacturing tolerances, means for securing said tube, flange members and reinforcing members together as a unified structure, each of said reinforcing members include means for securing a weight thereto for eccentrically balancing said warp beam, and said weight securing means are a pair of circumferential grooves.

20. A warp beam particularly adapted for warping, section warping or winding of threads, yarns or like textile material or synthetic melt-spun polymeric plastic material comprising a metallic tube having opposite axial ends and inner and outer peripheral surfaces, a flange member at each of said tube ends, each flange member including a generally peripheral flange and an axial collar, each axial collar having an outer peripheral surface, each collar outer peripheral surface being in internal spaced relationship to an associated one of said tube end inner peripheral surfaces, an annular reinforcing member having inner and outer peripheral surfaces, each annular reinforcing member being located between an associated collar outer peripheral surface and an adjacent tube end inner peripheral surface, said annular reinforcing members surfaces effectively compensating for out-of-roundness of said tube resulting from manufacturing tolerances, means for securing said tube, flange members and reinforcing members together as a unified structure, each of said reinforcing members include means for securing a weight thereto for eccentrically balancing said warp beam, and said weight securing means are a pair of axially oppositely opening circumferential grooves.

* * * * *